US009283652B2

(12) United States Patent
Ko et al.

(10) Patent No.: US 9,283,652 B2
(45) Date of Patent: Mar. 15, 2016

(54) EDGE GRINDING APPARATUS AND METHOD FOR GRINDING GLASS SUBSTRATE

(71) Applicant: Samsung Corning Precision Materials Co., Ltd., Gyeongsangbuk-do (KR)

(72) Inventors: Young Chae Ko, ChungCheongNam-Do (KR); Se-Yeon Kim, ChungCheongNam-Do (KR); Yeonhoon Kim, ChungCheongNam-Do (KR); Jun-Seok Kim, ChungCheongNam-Do (KR)

(73) Assignee: Corning Precision Materials Co., Ltd. (KR)

( * ) Notice: Subject to any disclaimer, the term of this patent is extended or adjusted under 35 U.S.C. 154(b) by 231 days.

(21) Appl. No.: 13/647,762

(22) Filed: Oct. 9, 2012

(65) Prior Publication Data

US 2014/0065928 A1 Mar. 6, 2014

(30) Foreign Application Priority Data

Sep. 5, 2012 (KR) ..... 10-2012-0098341

(51) Int. Cl.

| | |
|---|---|
| ***B24B 49/12*** | (2006.01) |
| ***B24B 9/10*** | (2006.01) |
| ***B24B 37/013*** | (2012.01) |
| ***B24B 49/00*** | (2012.01) |

(52) U.S. Cl.

CPC .. *B24B 49/12* (2013.01); *B24B 9/10* (2013.01)

(58) Field of Classification Search

CPC ..... B24B 9/10; B24B 49/12; B21B 1/00
USPC ..... 451/5, 6, 8–10, 41, 44, 57, 58, 65
See application file for complete search history.

(56) References Cited

U.S. PATENT DOCUMENTS

| | | | | |
|---|---|---|---|---|
| 2003/0190862 | A1 * | 10/2003 | Chae et al. | 451/5 |
| 2008/0132149 | A1 * | 6/2008 | Hwang et al. | 451/6 |
| 2010/0105289 | A1 * | 4/2010 | Yonezu et al. | 451/5 |

FOREIGN PATENT DOCUMENTS

| | | | | |
|---|---|---|---|---|
| JP | 07040239 | | 2/1995 | |
| JP | 2005153059 | A | 6/2005 | |
| JP | 2011110648 | A | 6/2011 | |
| KR | 20110041428 | A | 4/2011 | |
| TW | 200631915 | A | 9/2006 | |
| TW | 201117920 | A | 6/2011 | |
| WO | 2006087910 | A1 | 8/2006 | |
| WO | WO 2011031506 | A2 * | 3/2011 | B24B 9/10 |

OTHER PUBLICATIONS

Chinese Office Action for Taiwanese Application No. 101137957 dated Sep. 4, 2014, which claims priority to Korean Application No. 10-2012-0098341.

* cited by examiner

*Primary Examiner* — Monica Carter
*Assistant Examiner* — Lauren Beronja
(74) *Attorney, Agent, or Firm* — Lerner, David, Littenberg, Krumholz & Mentlik, LLP

(57) ABSTRACT

An edge grinding apparatus and method for grinding a glass substrate, with which a glass substrate can be ground by a fixed amount and the occurrence of defects can be minimized. The edge grinding apparatus includes an edge grinding unit which grinds a cut edge of a glass substrate while following the cut edge; a measuring unit which obtains positional information of the cut edge; and a control unit which receives the positional information of the cut edge from the measuring unit and controls a position of the edge grinding unit based on the positional information of the cut edge.

7 Claims, 4 Drawing Sheets

EDGE GRINDING APPARATUS AND METHOD FOR GRINDING GLASS SUBSTRATE

CROSS REFERENCE TO RELATED APPLICATION

The present application claims priority from Korean Patent Application Number 10-2012-0098341 filed on Sep. 5, 2012, the entire contents of which application are incorporated herein for all purposes by this reference.

BACKGROUND OF THE INVENTION

1. Field of the Invention

The present invention relates to an edge grinding apparatus and method for grinding a glass substrate, and more particularly, to an edge grinding apparatus and method for grinding a glass substrate, with which a glass substrate can be ground by a fixed amount and the occurrence of defects can be minimized.

2. Description of Related Art

In general, glass substrates for flat panel displays, such as plasma display panels (PDPs) or liquid crystal displays (LCDs), are used after having been machined to a predetermined size and shape.

Specifically, glass substrates undergo a machining process, which is generally divided into cutting, grinding and cleaning. In the machining process, the grinding process is performed such that the cut edge of a glass substrate cut in the cutting process is ground and is then polished using a grinding wheel.

In the current process of machining a glass substrate, the grinding process is performed by moving the glass substrate when the grinding wheel is fixed. Here, if the size of the glass substrate changes, it is misaligned before being ground, or the straightness of a grinding table which transports it while holding it via suction, changes, the grinding wheel grinds it by a greater or less amount than the fixed amount. This causes defects, such as insufficient grinding, burning, and fracturing, during this grinding process. In addition, this causes the edge of the glass substrate to fracture during post-processing, such as cleaning, inspection, and packing.

Here, the problem is that it is difficult to properly compensate for variation, such as changes in the size of the glass substrate, alignment mismatches, and changes in the straightness of the grinding table, in case that the grinding wheel is fixed. In an example, although the size of the glass substrate and the straightness of the grinding table must not vary over time once they have been mechanically set to an accurate value, variation from several to tens of micrometers occurs, depending on the processing conditions. In addition, the alignment of the glass substrate on the grinding table before grinding the glass substrate results in an error of tens of micrometers, since the aligning need to mechanically push four edges of the glass substrate.

Accordingly, in the related art, the amount by which a glass substrate is ground is not set to a fixed value because of the defects occurring due to the foregoing phenomena, and thus the amount of grinding must be frequently adjusted during the manufacture of the glass substrate.

The information disclosed in this Background of the Invention section is only for the enhancement of understanding of the background of the invention, and should not be taken as an acknowledgment or any form of suggestion that this information forms a prior art that would already be known to a person skilled in the art.

BRIEF SUMMARY OF THE INVENTION

Various aspects of the present invention provide an edge grinding apparatus for grinding a glass substrate, with which a glass substrate can be ground by a fixed amount and the occurrence of defects can be minimized.

In an aspect of the present invention, provided is an edge grinding apparatus for grinding a glass substrate. The edge grinding apparatus includes an edge grinding unit which grinds a cut edge of a glass substrate while following the cut edge; a measuring unit which obtains positional information of the cut edge; and a control unit which receives the positional information of the cut edge from the measuring unit and controls a position of the edge grinding unit based on the positional information of the cut edge.

The measuring unit may include at least one of: a first measuring unit installed in an upstream of the edge grinding unit with respect to a path along which the glass substrate moves, the first measuring unit photographing an image of a pre-ground cut edge of the glass substrate and transmitting the photographed image of the pre-ground cut edge to the control unit; and a second measuring unit installed in a downstream of the edge grinding unit with respect to the path along which the glass substrate moves, the second measuring unit photographing an image of a ground cut edge of the glass substrate and transmitting the photographed image of the ground cut edge to the control unit.

The control unit may include a controller, the controller controlling the position of the edge grinding unit so that the edge grinding unit grinds the cut edge while following the cut edge.

The edge grinding unit may include a rough grinding wheel and a finishing wheel, and the control unit may include a first controller which controls a position of the rough grinding wheel so that the rough grinding wheel grinds the cut edge while following the cut edge; and a second controller which controls a position of the finishing wheel so that the finishing wheel grinds the cut edge while following the cut edge.

The control unit may further include a third controller, the third controller applying a control signal to the first controller and a control signal to the second controller, based on the positional information of the cut edge and positional information of the rough grinding wheel and the finishing wheel, so that the rough grinding wheel and the finishing wheel grind the cut edge of the glass substrate while following the cut edge.

In another aspect of the present invention, provided is an edge grinding method for grinding a glass substrate using an edge grinding apparatus as described above.

According to embodiments of the invention, the measuring unit is installed in an upstream and/or a downstream of the grinding wheel such that it obtains positional information of the cut edge of a glass substrate, and a position of the grinding wheel is controlled based on the positional information of the cut edge obtained by the measuring unit, so that the grinding wheel grinds the cut edge while following it. Even when the glass substrate is subjected to an align mismatch or the size of the glass substrate is changed, the glass substrate can be ground by a fixed amount. Accordingly, it is possible to minimize the occurrence of defects, such as insufficient grinding, grinding debris, or fracturing, which would occur in the grinding process of the related art.

The methods and edge grinding apparatuses of the present invention have other features and advantages which will be apparent from, or are set forth in greater detail in the accompanying drawings, which are incorporated herein, and in the following Detailed Description of the Invention, which together serve to explain certain principles of the present invention.

DETAILED DESCRIPTION OF THE INVENTION

Figure 1:
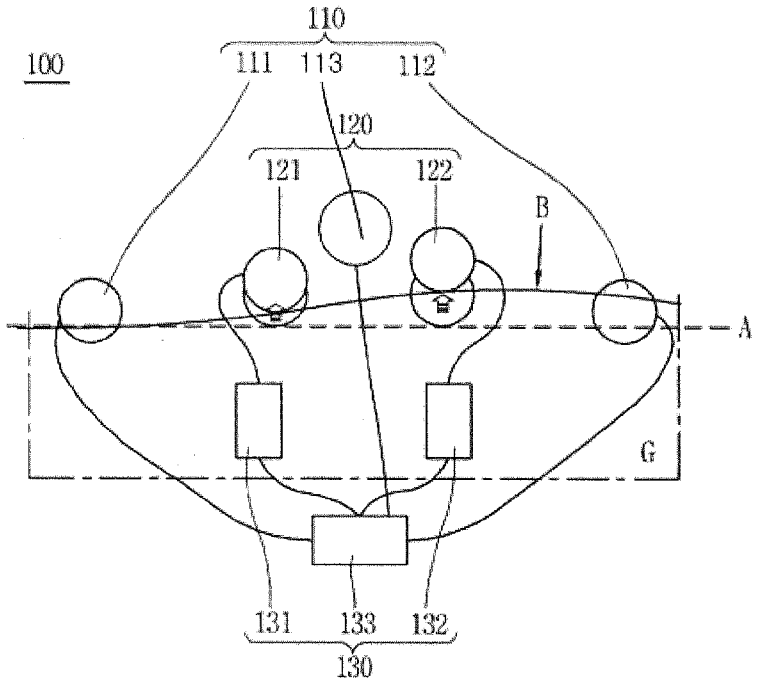
FIG. 1 is a conceptual view schematically showing an edge grinding apparatus for grinding a glass substrate according to an exemplary embodiment of the invention.

Reference will now be made in detail to various embodiments of the present invention, examples of which are illustrated in the accompanying drawings and described below, so that a person having ordinary skill in the art to which the present invention relates can easily put the present invention into practice.

Throughout this document, reference should be made to the drawings, in which the same reference numerals and signs are used throughout the different drawings to designate the same or similar components. In the following description of the present invention, detailed descriptions of known functions and components incorporated herein will be omitted when they may make the subject matter of the present invention unclear.

With reference to FIG. 1 to FIG. 4, a description will be given below of an edge grinding apparatus for grinding a glass substrate according to an exemplary embodiment of the invention.

Referring to FIG. 1, the edge grinding apparatus 100 for grinding a glass substrate of this embodiment is an edge grinding apparatus that grinds a cut edge of a glass substrate G, which is cut to a predetermined shape and size in a cutting process. The edge grinding apparatus 100 includes a measuring unit 110, an edge grinding unit 120 and a control unit 130. Although not shown in the figures, the edge grinding apparatus also includes a grinding table, which aligns the glass substrate G, holds it via suction, and transports it in one direction. The grinding table may transport the glass substrate G using a conveyor belt or rollers. The measuring unit 110 and the edge grinding unit 120 are provided on the grinding table in order to grind the glass substrate G that is being transported on the grinding table.

The measuring unit 110 is a device that measures the position of the cut edge of the glass substrate G in order to grind the glass substrate G while following it. For this, the measuring unit 110 is connected to the control unit 130, and transmits the positional information to the control unit 130. Here, the measurement of the cut edge of the glass substrate G is performed when the glass substrate G is initially placed on the grinding table, and after the glass substrate G has passed through the edge grinding unit 120. Therefore, the measuring unit 110 may include a plurality of measuring units, which are provided in an upstream and/or downstream of the edge grinding unit 120. According to an exemplary embodiment of the invention, the measuring unit 110 may include a first measuring unit 111 and a second measuring unit 112.

The first measuring unit 111 is a device that provides data in use for determining the position of the edge grinding unit 120 in order to grind the glass substrate G while following it, although it is misaligned because of, for example, an alignment mismatch. For this, the first measuring unit 111 is disposed in an upstream of the edge grinding unit 120 with respect to the path along which the glass substrate G is transported in order to photograph an image of the glass substrate G, i.e. an image of the cut edge of the glass substrate before being ground. Therefore, the first measuring unit 111 transmits the photographed image to the control unit 130, so that the photographed image can be used as the data in determining the position of the edge grinding unit 120. The first measuring unit 111 may be a photographic means, such as a camera.

In addition, the second measuring unit 112 is a device that provides feedback data for the grinding amount and the grinding width by which the cut edge has been ground. Such feedback data is applied in the following process of grinding the cut edge of the glass substrate G, thereby contributing to an improvement in the quality of grinding. For this, the second measuring unit 112 is disposed in the downstream of the edge grinding unit 120 in order to photograph an image of the glass substrate G, that is, an image of the cut edge of the glass substrate G after being ground. In addition, the second measuring unit 112 transmits the photographed image to the control unit 130, so that the photographed image can be used as feedback data for the following grinding process of the edge grinding unit 120. The second measuring unit 112 may be a photographing means, such as a camera, like the first measuring unit 111.

In addition, the measuring unit 110 may also include another measuring unit (113), which photographs the edge grinding unit 120, in order to compensate for the position of the edge grinding unit 120 or the path along which the edge grinding unit 120 moves.

In this way, the measuring unit 110 provides the image of the pre-ground cut edge of the glass substrate G, which is taken by the first measuring unit 111, and the image of the ground cut edge of the glass substrate G, which is taken by the second measuring unit 112, to the control section 130, so as to grinding the edge grinding unit 120 under the control of the control unit 130 while following it, thereby enabling the cut edge of the glass substrate G to be ground by a fixed amount. When the grinding by a fixed amount is realized in this way, it is possible to minimize defects, such as insufficient grinding, grinding debris, or fracturing, which would occur in the grinding process of the related art.

The edge grinding unit 120 is a device that grinds the cut edge of the glass substrate G. Here, the edge grinding unit 120 according to an exemplary embodiment of the invention grinds the glass substrate G while following the cut edge. The edge grinding unit 120 is provided on the grinding table (not shown) in the downstream of the first measuring unit 111 of the measuring unit 110.

The edge grinding unit 120 may include grinding wheels, for example, a rough grinding wheel 121 and a finishing wheel 122, in order to grind the cut edge of the glass substrate G. Here, the rough grinding wheel 121 is a grinding wheel that roughly grinds the cut edge of the glass substrate G, which is being transported on the grinding table (not shown). For example, when the glass substrate G is being transported out of a desired position due to a change in size thereof, an alignment mismatch, or the like (B: the path along which the glass substrate G is transported), the glass substrate G strays from the path A, which is set in advance such that the glass substrate G is to be transported along it. Even in this case, the rough grinding wheel 121 roughly grinds the cut edge of the glass substrate G which is out of the desired position, while following it. For this, the rough grinding wheel 121 is provided on the grinding table (not shown) such that it is movable along the path B along which the glass substrate G is transported. Here, the process of following the cut edge of the glass substrate G is controlled by the control unit 130, and will be described in more detail later.

The finishing wheel 122 is a grinding wheel that precisely grinds the cut edge of the glass substrate G, which has been roughly ground by the rough grinding wheel 121. The finishing wheel 122 is provided on the grinding table (not shown), installed in the downstream of the rough grinding wheel 121. Like the rough grinding wheel 121, the finishing wheel 122 is configured such that it follows the cut edge of the glass substrate G, that is, it is movable along the path B along which the glass substrate G is transported. Here, as in the rough grinding wheel 121, the process in which the finishing wheel 122 follows the cut edge of the glass substrate G is controlled by the control unit 130, which will also be described in more detail later.

In addition, a plurality of rough grinding wheels 121 and a plurality of finishing wheels 122 may be provided as required. Here, the plurality of rough grinding wheels 121 and the plurality of finishing wheels 122 are arranged in the order in which the roughness of the wheels 121, 122 decreases, in the direction in which the glass substrate G is transported.

Figure 2:
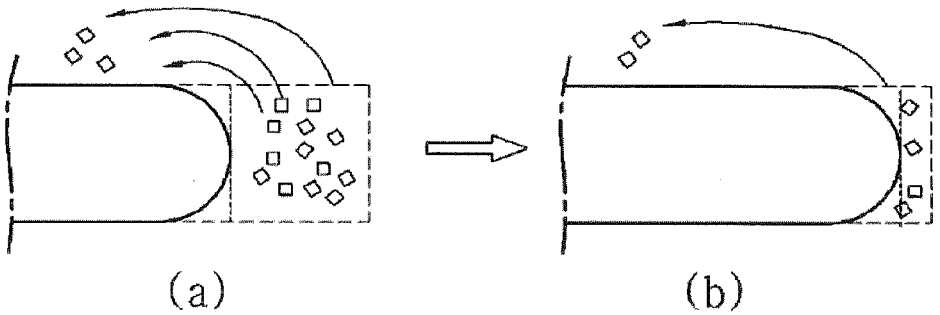
FIG. 2 is a schematic view comparatively showing the state in which a glass substrate is ground using the edge grinding apparatus for grinding a glass substrate according to an exemplary embodiment of the invention and the state in which a glass substrate is ground using an edge grinding apparatus for grinding a glass substrate of the related art.

In this way, when the edge grinding unit 120 grinds the cut edge of the glass substrate G while following it, it is possible to grind the glass substrate by a fixed minimum amount, as shown in FIG. 2 (*b*), so that the cut edge of the glass substrate G can be ground to a depth that is shallower than the depth to which the glass substrate is ground in the related art, as shown in FIG. 2 (*a*). This makes it possible to minimize the amount of particles that are introduced to the surface of the glass substrate G, thereby improving the quality of the edge of the glass substrate G.

The control unit 130 is a device that controls the measuring unit 110 and the edge grinding unit 120. Herein, the control unit 130 according to an exemplary embodiment of the invention can individually control the measuring unit 110 and the edge grinding unit 120. For this, the control unit 130 may include a first controller 131, a second controller 132 and a third controller 133.

The first controller 131 is connected to the rough grinding wheel 121, and controls the position of the rough grinding wheel 121. That is, the first controller 131 moves the rough grinding wheel 121 so that the rough grinding wheel 121 grinds the cut edge of the glass substrate G while following it. Here, the first controller 131 controls the rough grinding wheel 121 using a control signal from the third controller 133, based on an image photographed by the measuring unit 110.

The second controller 132 is connected to the finishing wheel 122, and controls the position of the finishing wheel 122. That is, the second controller 132 moves the finishing wheel 122 so that the finishing wheel 122 grinds the cut edge of the glass substrate G while following it. Here, like the first controller 131, the second controller 132 controls the finishing wheel 122 using a control signal from the third controller 133.

The third controller 133 is a main controller that controls the first controller 131 and the second controller 132. The third controller 133 receives images of the cut edge of the glass substrate G, which are transmitted from the measuring unit 110. The third controller 133 applies a control signal for the operation of the rough grinding wheel 121 to the first controller 131 and a control signal for the operation of the finishing wheel 122 to the second controller 132, so that the rough grinding wheel 121 and the finishing wheel 122 can grind the cut edge of the glass substrate G while following it.

As described above, the edge grinding apparatus 100 according to an exemplary embodiment of the invention can grind the glass substrate by a fixed amount even when the glass substrate G is subjected to an alignment mismatch or the size of the glass substrate is changed, since the edge grinding unit 120 can grind the glass substrate G while following it under the control of the control unit 130. Accordingly, it is possible to minimize defects, such as excessive grinding, grinding debris, or fracturing, which would occur in the grinding process of the related art.

Figure 3A:
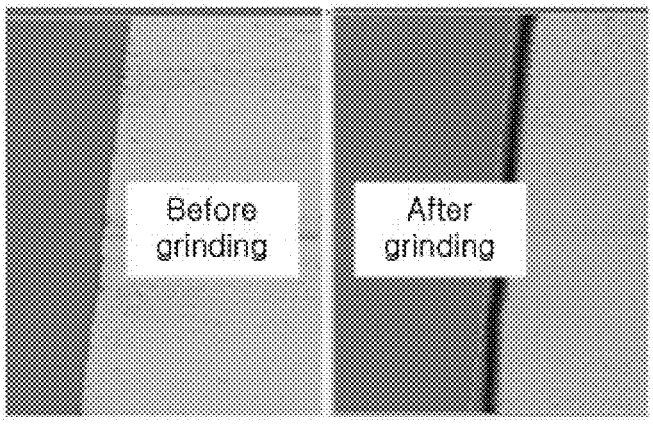
FIG. 3A to FIG. 3D are views showing images of glass substrates, which were ground using the edge grinding apparatus for grinding a glass substrate according to an exemplary embodiment of the invention.
Figure 3B:
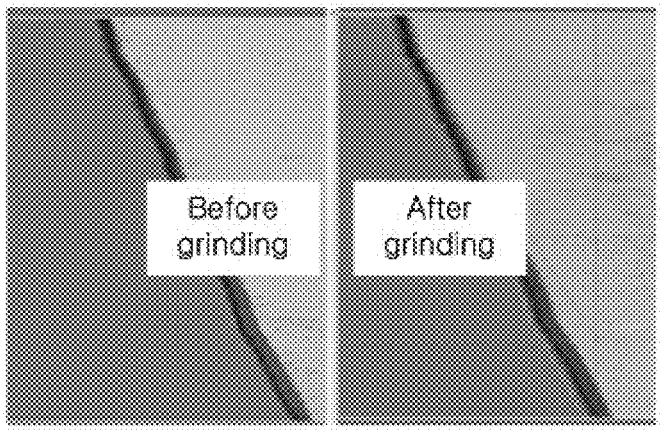
Figure 3C:
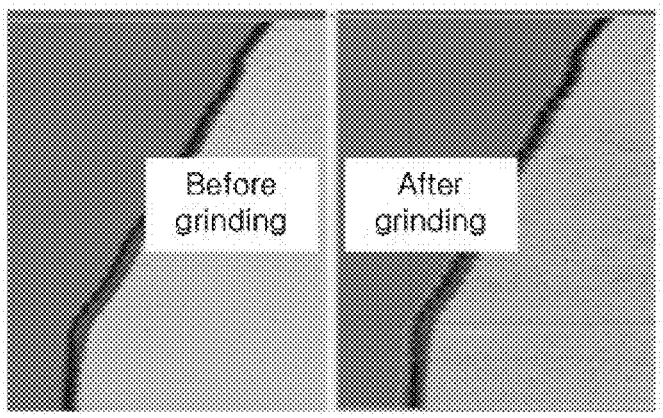
Figure 3D:
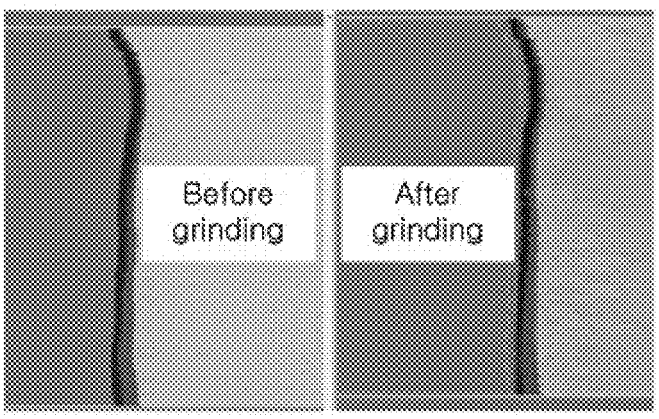

FIG. 3A to FIG. 3D are views showing images of glass substrates before and after the glass substrates have been ground using the edge grinding apparatus for grinding a glass substrate according to an exemplary embodiment of the invention. FIG. 3B and FIG. 3C show the images of the cut edge with different shapes, before and after the cut edge was ground, when an alignment mismatch was 3 mm. FIG. 3D shows the images of the cut edge with a sharp gradient, before and after the cut edge was ground. These images of the glass substrates G which were ground using the edge grinding apparatus 100 according to an exemplary embodiment of the invention, shows that, even when the alignment of a glass substrate G is mismatched, the edge grinding unit 120 ground the glass substrate G while following it, based on how much it is out of the desired position.

Figure 4A:
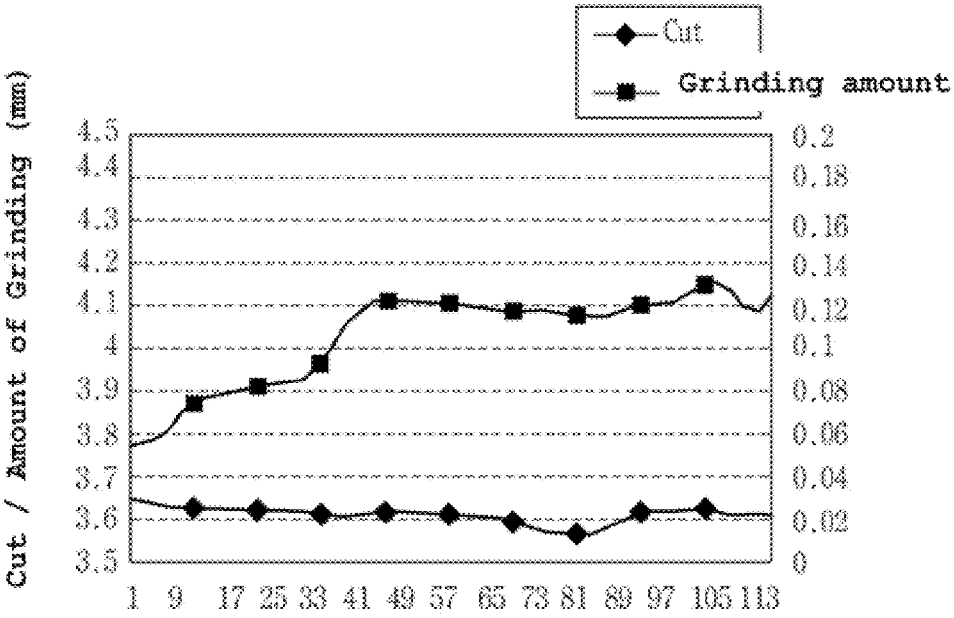
FIG. 4A and FIG. 4B are graphs comparatively showing the amounts by which a glass substrate was ground depending on whether or not the edge grinding apparatus for grinding a glass substrate according to an exemplary embodiment of the invention was used.
Figure 4B:
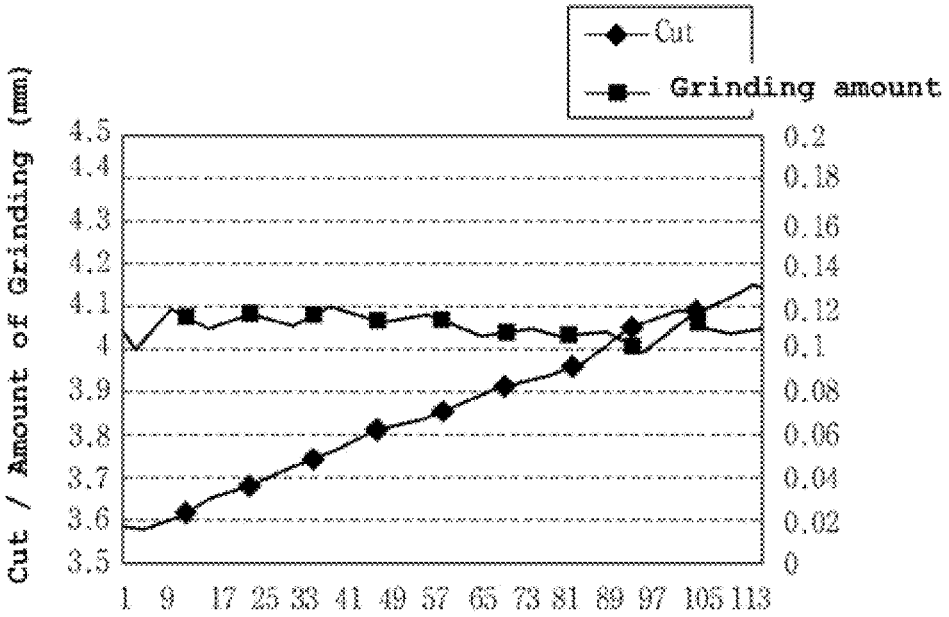

Furthermore, FIG. 4A and FIG. 4B are graphs comparatively showing the amounts by which a glass substrate was ground depending on whether or not the edge grinding apparatus for grinding a glass substrate according to an exemplary embodiment of the invention was used. (x-coordinates correspond to respective points from one end to the other end of an edge of the glass substrate) FIG. 4A shows that, when the edge grinding apparatus 100 was turned off, there may be a large dispersion of the grinding amount even in a glass substrate having a cut edge with high linearity. In contrast, as shown in FIG. 4B, when the edge grinding apparatus 100 was turned on, the fixed amount of grinding was obtained. In this way, when the cut edge of the glass substrate G is cut by a fixed amount, the number of sheets of glass substrates G that can be ground can be increased as much as about 1.5 times.

The foregoing descriptions of specific exemplary embodiments of the present invention have been presented with respect to the certain embodiments and drawings. They are not intended to be exhaustive or to limit the invention to the precise forms disclosed, and obviously many modifications and variations are possible for a person having ordinary skill in the art in light of the above teachings.

It is intended therefore that the scope of the invention not be limited to the foregoing embodiments, but be defined by the Claims appended hereto and their equivalents.

What is claimed is:

1. An edge grinding apparatus for grinding a glass substrate, comprising:

an edge grinding unit which grinds a cut edge of a glass substrate while following the cut edge;

a measuring unit which measures positional information of the cut edge; and a control unit which receives the positional information of the cut edge from the measuring unit and controls a position of the edge grinding unit based on the positional information of the cut edge;

wherein the measuring unit comprises a first measuring unit installed upstream of the edge grinding unit with respect to a path along which the glass substrate moves, the first measuring unit measuring the positional information of the cut edge of the glass substrate before being ground by the edge grinding unit, and the control unit controls the position of the edge grinding unit based on the positional information of the cut edge of the glass substrate before being ground by the edge grinding unit.

2. The edge grinding apparatus of claim 1, wherein the measuring unit further comprises a second measuring unit installed downstream of the edge grinding unit with respect to the path along which the glass substrate moves, the second measuring unit photographing an image of the cut edge of the glass substrate after being ground and transmitting the photographed image of the cut edge after being ground to the control unit.

3. The edge grinding apparatus of claim 1, wherein the control unit controls the position of the edge grinding unit so that the edge grinding unit grinds the cut edge while following the cut edge.

4. The edge grinding apparatus of claim 3, wherein the edge grinding unit comprises a rough grinding wheel and a finishing wheel in the order named with respect to a path along which the glass substrate moves, and the control unit comprises:

a first controller which controls a position of the rough grinding wheel so that the rough grinding wheel grinds the cut edge while following the cut edge; and a second controller which controls a position of the finishing wheel so that the finishing wheel grinds the cut edge while following the cut edge.

5. The edge grinding apparatus of claim 4, wherein the control unit further comprises a third controller, the third controller applying a control signal to the first controller and a control signal to the second controller, based on the positional information of the cut edge and positional information of the rough grinding wheel and the finishing wheel, so that the rough grinding wheel and the finishing wheel grind the cut edge of the glass substrate while following the cut edge.

6. An edge grinding method for grinding a glass substrate comprising:

measuring, with a measuring unit, positional information of a cut edge of a glass substrate;

receiving, by a control unit, the positional information of the cut edge;

controlling, with the control unit, a position of an edge grinding unit based on the positional information of the cut edge; and grinding, with the edge grinding unit, the cut edge while following the cut edge;

wherein measuring with the measuring unit comprises measuring, with a first measuring unit installed upstream of the edge grinding unit with respect to a path along which the glass substrate moves, the positional information of the cut edge of the glass substrate before being ground by the edge grinding unit, and controlling with the control unit comprises controlling the position of the edge grinding unit based on the positional information of the cut edge before being ground by the edge grinding unit.

7. The edge grinding apparatus of claim 1, wherein the first measuring unit photographs an image of the cut edge of the glass substrate before being ground and transmits the photographed image of the cut edge before being ground to the control unit.

* * * * *